US005257698A

United States Patent [19]

Christ et al.

[11] Patent Number: 5,257,698

[45] Date of Patent: Nov. 2, 1993

[54] CLEANER FOR STOCK SUSPENSIONS

[75] Inventors: Alfred Christ, Zurich, Switzerland; Herbert Holik, Ravensburg, Fed. Rep. of Germany; Erich Linck, Ravensburg, Fed. Rep. of Germany; Wolfgang Siewert, Ravensburg, Fed. Rep. of Germany

[73] Assignee: Sulzer Escher Wyss GmbH, Ravensburg, Fed. Rep. of Germany

[21] Appl. No.: 841,080

[22] Filed: Feb. 25, 1992

[30] Foreign Application Priority Data

Feb. 26, 1991 [DE] Fed. Rep. of Germany ..... 4105903

[51] Int. Cl.[5] ..... B04B 3/00

[52] U.S. Cl. ..... 209/210; 209/211; 210/512.1

[58] Field of Search ..... 209/144, 210, 211; 210/512.1

[56] References Cited

U.S. PATENT DOCUMENTS

| | | | |
|---|---|---|---|
| 2,748,668 | 6/1956 | Hornbostel | 92/28 |
| 3,351,195 | 11/1967 | Hukki | 209/211 |
| 4,332,350 | 6/1982 | McClellan | 232/7 |
| 4,443,331 | 4/1984 | Amand | 209/211 |

FOREIGN PATENT DOCUMENTS

| | | | |
|---|---|---|---|
| 521185 | 1/1956 | Canada | 209/141 |
| 0037347 | 10/1981 | European Pat. Off. . | |
| 0359682 | 3/1990 | European Pat. Off. . | |
| 1220392 | 2/1961 | Fed. Rep. of Germany | 210/512.1 |
| 2063063 | 7/1970 | Fed. Rep. of Germany . | |
| 1450895 | 7/1966 | France . | |
| 2596668 | 10/1987 | France | 210/512.1 |
| 144208 | 2/1954 | Sweden | 209/211 |
| 253544 | 3/1948 | Switzerland . | |
| 0663436 | 5/1979 | U.S.S.R. | 209/211 |
| 722120 | 1/1955 | United Kingdom | 209/211 |
| 1366170 | 9/1974 | United Kingdom . | |

*Primary Examiner*—H. Grant Skaggs
*Assistant Examiner*—Carol Lynn Druzbick
*Attorney, Agent, or Firm*—Sandler Greenblum & Bernstein

[57] ABSTRACT

Pump-like inlet blading has operatively connected therewith a multi-stage stepped diffusor axially opening into a separation chamber. For the removal of light particles, openings or recesses are provided at the outlet side of an inner cylinder and such merge with withdrawal channels at the inner cylinder. If necessary, there are provided for the heavy particles a collecting groove at least in front of turbine-like outlet blading and from which lead openings, so-called saveall openings towards the outside. These saveall openings are briefly alternatingly opened and closed during operation of the stock suspension cleaner. The fluid stream of the cleaned stock suspension is removed by the turbine-like outlet blading. At least one part of the inner cylinder which delimits the separation chamber is separately rotatable relative to the outer cylinder, so that such inner cylinder part can be rotated at a different rotational speed than the outer cylinder. The inner cylinder part carries at least one scraper which, during operation, clears the inner wall of the outer cylinder to preclude any caking thereat of heavy particle accumulations and promoting further conveyance of the heavy particles. The rotating inner cylinder part also carries a pusher ring which revolving moves in the collecting groove, pushes the heavy particles towards the saveall openings and alternately opens and closes these saveall openings.

30 Claims, 2 Drawing Sheets

CLEANER FOR STOCK SUSPENSIONS

BACKGROUND OF THE INVENTION

1. Field of the Invention

The present invention relates to a new and improved cleaner for stock suspensions, especially for waste paper-fiber stock suspensions from which there are to be eliminated light particles or both light and heavy particles.

Generally speaking, the cleaner for stock suspensions formed from waste paper, as contemplated by the present development, is of the type comprising a rotatable hollow outer cylinder or cylinder member within which there is coaxially arranged for co-rotation an inner cylinder or cylinder member. An annular or circular ring-shaped separation chamber is located between the outer and inner cylinders and the stock suspension flows in substantially axial direction through such separation chamber. Moreover, this separation chamber is provided with a pump-like inlet blade structure or blade means for the transport of the stock suspension into the separation chamber. A turbine-like outlet blade structure or blade means is arranged after, that is, downstream of the pump-like inlet blade structure or blade means. Leading from the separation chamber is a separate discharge for the light particles, if desired, a separate discharge for the heavy particles and for the cleaned stock suspension.

2. Discussion of the Background and Material Information

A similar type of cleaner or cleaning apparatus for stock suspensions has been disclosed in European Published Patent Application No. 0,037,347, published Oct. 10, 1991 and the cognate U.S. Pat. No. 4,443,331, granted Apr. 17, 1984. A different construction of centrifugal cleaner has been disclosed in Swiss Patent No. 253,544, granted Mar. 15, 1948. The suspension to be cleaned is caused to rotate in the separation chamber upon rotation of the cleaner. Due to the centrifugal force the light particles collect in the direction of the center line of the cleaner whereas the heavy particles are collected at the outer region of such cleaner. Through the provision of separate discharge lines these contaminants or rejects are intended to be separately removed from the good stock, in other words, from the cleaned stock suspension.

While partial success has been realized with such cleaners in practice, nonetheless they possess the drawback that such cleaners require a comparatively large amount of space since they are generally erected in a horizontal position. Furthermore, the cleaning action is unsatisfactory when separating light particles or rejects under unfavorable conditions. The separation of heavy particles or rejects could not be satisfactorily accomplished. Therefore, such cleaners were arranged behind or downstream of equipment for the separation of heavy particles or rejects.

SUMMARY OF THE INVENTION

Therefore, with the foregoing in mind, it is a primary object of the present invention to provide an improved construction of cleaner for stock suspensions which is not afflicted with the aforementioned shortcomings and drawbacks of the prior art.

Another and more specific object of the present invention aims at providing an improved construction of cleaner or cleaning apparatus for stock suspensions which is capable of effectively eliminating light particles or rejects and, if desired or required, heavy particles or rejects, which have the tendency of caking together into crusts or the like.

Still a further noteworthy object of the present invention is the provision of an improved construction of cleaner for stock suspensions which is relatively simple in construction and design, extremely reliable in operation, not readily subject to breakdown or malfunction and requires relatively little maintenance.

Yet a further important object of the present invention aims at providing an improved construction of cleaner or cleaning apparatus for stock suspensions which is capable of effectively eliminating light particles or rejects and, if desired or required, heavy particles or rejects, and wherein it is possible to eliminate the need, as heretofore required, to provide forward or upstream arranged equipment for the separation of heavy particles or rejects.

Another noteworthy object of the present invention aims at providing an improved construction of cleaner or cleaning apparatus for reliably and efficiently cleaning stock suspensions and which occupies comparatively little space.

Now in order to implement these and still further objects of the present invention, which will become more readily apparent as the description proceeds, the stock suspension cleaner or cleaning apparatus of the present development is manifested, among other things, by the features that a multi-stage stepped diffusor is arranged directly after or downstream of the inlet blade structure with respect to a predetermined direction of flow of the stock suspension. This multi-stage stepped diffusor opens into or flow communicates with the separation chamber in the direction of the lengthwise axis of such separation chamber. Means defining discharge openings are provided at the end of the inner cylinder located at the outlet side or region of such inner cylinder and serve for the removal or discharge of the light particles or rejects. These discharge openings are located forwardly or upstream of the turbine-like outlet blade structure or blade means. Furthermore, the discharge openings extend through the wall of the inner cylinder into the interior or inner space of such inner cylinder for the throughput of the separated light particles or rejects together with a liquid constituent. The turbine-like outlet blade structure or blade means is structured for receiving and further conveying or transporting a main stream of the cleaned stock suspension.

The centrifugal force is exploited in usual manner during operation of the stock suspension cleaner, and in the existing rotation field of the cleaner the heavy particles collect at the inner wall of the outer cylinder whereas the light particles tend to move inwardly towards the outer wall of the inner cylinder. The stock suspension to be cleaned is infed in known manner in axial direction of the cleaner and conveyed by the pump-like blade structure in the direction of the separation chamber where, at the end of each pump blading-flow channel, there is present a stepped diffusor providing a sudden enlargement of the flow channels which is advantageously accomplished in two step jumps or transitions. This stepped diffusor opens into the separation chamber in the direction of the lengthwise axis thereof.

The step-like enlargement or widening of the flow channels induces in the stock suspension flow an intensive isotropic turbulence capable of breaking apart or disintegrating any fiber agglomerations or lumps which may have possibly formed about the rejects or stock constituents intended to be eliminated, and thus, releases or freely exposes such rejects or stock constituents.

In order to maintain or further augment such turbulence there can be provided, if necessary, as for instance, when dampening of the turbulence is rather great due to a high fiber content or concentration, additional turbulence generators at the inner cylinder. These additional turbulence generators can be constituted, for example, by nose-shaped displacement bodies or protuberances which extend into the stock suspension flow present within the separation chamber.

The separation chamber is advantageously of annular or circular configuration. It has been found advantageous to provide a radius ratio between the inner cylinder and the outer cylinder in a range of about 0.5 to 0.85, especially about 0.70.

The removal of the light particles or rejects which collect at the inner cylinder of the separation chamber, is accomplished by chute-like openings or recesses provided at the inner cylinder at the region of the outlet or discharge end thereof. These openings or recesses open into channels provided between conical jackets or shells which close the inner cylinder. These channels extend into or flow communicate with a stationary central pipe or tube. Both of the conical jackets which bound or delimit these channels terminate at a seal. By means of the central pipe or tube it is possible to remove the light particles together with a certain amount of liquid of the stock suspension which have been separated from the main stream or flow of such stock suspension. Advantageously, the amount of stock suspension which accompanies the light particles or rejects is in the order of about 0.5 percent by weight to 3 percent by weight of the stock suspension stream which flows through the cleaner.

The construction of the cleaner of the present invention embodying the annular or circular-shaped separation chamber and, according to one exceedingly advantageous embodiment, the separate rotational mounting of a separate part or component of the multi-part inner cylinder renders it possible, through the use of suitable speed reduction gearing having a considerable speed reduction capability, such as so called cyclo or wobble gearing, possessing coaxial drive and power-take off shafts, to maintain the rotational speed of the separate part of the inner cylinder so as to be somewhat larger or smaller than the rotational speed of the outer cylinder. This drive shaft can be selectively driven at any desired speed between null rotational speed and a predetermined rotational speed value, so that there is established relative rotation between the separate rotatable part of the inner cylinder and the outer cylinder.

Furthermore, this speed reduction gearing is mounted at the conical end portion of the outer cylinder, that is, in the conical jacket closing or terminating the inner cylinder. The speed reduction gearing is advantageously selected or structured such that the rotational speed difference lies in a range of about 0.1% and 2.0%, preferably at about 0.5%. To maintain the gearing-drive shaft at the aforementioned null-rotational speed, such gearing-drive shaft is stationarily held in the central pipe or tube serving for the withdrawal of the light particles or rejects. In order to be able to change the relative velocity or speed of the separate rotational part of the multi-part inner cylinder in relation to the outer cylinder, this gearing-drive shaft can be driven by any suitable drive motor.

The separate rotatable part of the multi-part inner cylinder advantageously supports at least one scraper or doctor blade insertable into an associated axially parallel groove provided at the outer wall of the inner cylinder. During operation, this at least one scraper or doctor blade continuously scrapes the inner wall of the outer cylinder in order to maintain such free from solid agglomerations or cakes formed of particles, in that such particles, specifically the heavy particles, during every throughpass of the scraper or doctor blade, are somewhat agitated and then further conveyed by the flow drag forces. It is advantageous if a plurality of such scrapers or doctor blades are arranged at a substantially uniform mutual circumferential spacing from one another at the inner cylinder.

According to a further embodiment of the present invention, it would be possible to drive the inner and outer cylinders at the same rotational speeds.

The present invention further contemplates that a respective revolving annular or circular-shaped collecting groove is provided at least at the outlet end of the separation chamber, but possibly also at the central region thereof and/or immediately at the neighborhood of the inlet section or region of the separation chamber, should it be desired or necessary to remove coarse heavy particles or rejects. The heavy particles or rejects fall into such revolving collecting groove or grooves, as the case may be. During operation of the cleaner, a pusher ring or slide member co-rotates in the associated groove. This pusher ring is dragged along or entrained by the rotating inner cylinder or the separate rotatable part thereof. The pusher ring supports ribs members or the like which displace the heavy particles in circumferential direction towards one or preferably a number of exit or discharge openings, so-called saveall openings, arranged at a substantially mutually equidistant circumferential spacing from one another. These saveall openings extend through the wall of the outer cylinder. Furthermore, such saveall openings are appropriately briefly intermittently controlled, that is, selectively opened and closed by a pusher opening provided at the pusher ring during rotational movement of such pusher ring. Due to the excess pressure of the stock suspension in the separation chamber a forceful stock suspension flow occurs through such saveall openings each time when these saveall openings are opened. This forceful stock suspension flow outwardly entrains the heavy particles or rejects which have collected at the neighborhood of the rib members of the pusher or slide member. At this location there is arranged a stationary collecting trough or vat or equivalent structure which surrounds the outer cylinder and collects and removes the effluxing heavy particles or rejects.

Continuing, it will be appreciated that deflection elements can be advantageously mounted at the region of the saveall openings located at the outer wall of the outer cylinder. These deflection elements rearwardly deflect the emerging heavy particle jet relative to the direction of rotation of the outer cylinder. As a result, this heavy particle jet impinges with a tangential velocity component and with relatively low relative velocity at the wall of the collecting trough. This action favors a reduction in wear which might arise at the collecting trough, results in a reduced formation of stock suspension spatters or water spatters, and additionally, produces a certain drive force.

To ensure that the walls of the equipment which come into contact with the concentrated heavy particles are protected as good as possible against wear, these walls can be lined with wear-resistant linings or coverings, especially the walls bounding the internal contour or space of the outer cylinder, the walls of the revolving collecting grooves, those of the saveall openings provided with the deflection elements as well as the walls of the collecting troughs.

Random erection of the cleaner is possible since the centrifugal acceleration governed by the explained rotation amounts to a multiple of the gravitational acceleration. In order to satisfy the above-mentioned requirement that the cleaner occupy a relatively small amount of space, it is preferable to erect the cleaner such that it has an upright or vertical disposition of its lengthwise axis. It is basically immaterial whether the stock suspension inlet is arranged at the top or bottom of the cleaner, although it is preferable to have such suspension inlet located at the cleaner bottom. Since such cleaner constitutes a rapidly rotating, comparatively heavy piece of equipment, care must be exercised with regard to the bearings in respect of critical rotational speeds. To that end, both of the bearing housings which support the outer cylinder are each secured at a respective plate member which, in turn, are interconnected with one another by rigid connection elements. These plate members and their connecting supports form an inner frame or frame structure which is supported by elastic dampening elements in relation to traverses or cross beams of an outer frame or frame structure which can be fabricated with quite coarse tolerances. In order to shift the most important critical rotational speeds into innocuous speed ranges it is possible to freely select the site, number and hardness of these elastic dampening elements as dictated by prevailing requirements.

Since the scrapers or doctor blades in the separation chamber are to be viewed as wearable parts consideration should be given as concerns easy replacement thereof. To that end, the entire cleaner is constructed such that after releasing a few flange connections and following removal of an element which can be easily dismantled the entire separation chamber can be lowered by a device mounted at the inner frame and then outwardly pivoted or shifted, so that the annular separation chamber is accessible in axial direction from above and any possibly worn scrapers can be easily retracted from their receiving grooves and replacement scrapers inserted.

It is also advantageous to provide easily and rapidly dismountable parts at the outer walls of the stock suspension cleaner at those locations which are particularly prone to soiling or contamination, for example, by providing suitable access openings, such as hand-receiving ports or holes. As a result, there can be performed inspection and/or cleaning of the equipment during brief standstill times thereof.

BRIEF DESCRIPTION OF THE DRAWINGS

The invention will be better understood and objects other than those set forth above, will become apparent when consideration is given to the following detailed description thereof. Such description makes reference to the annexed drawings wherein throughout these drawings there have been generally used the same reference characters for the same or analogous components, and wherein.

DETAILED DESCRIPTION OF THE PREFERRED EMBODIMENTS

Describing now the drawings, it is to be understood that only enough of the construction of the stock suspension cleaner or cleaning apparatus of the present invention has been depicted therein, in order to simplify the illustration, as needed for those skilled in the art to readily understand the underlying principles and concepts of the present invention.

Figure 1:
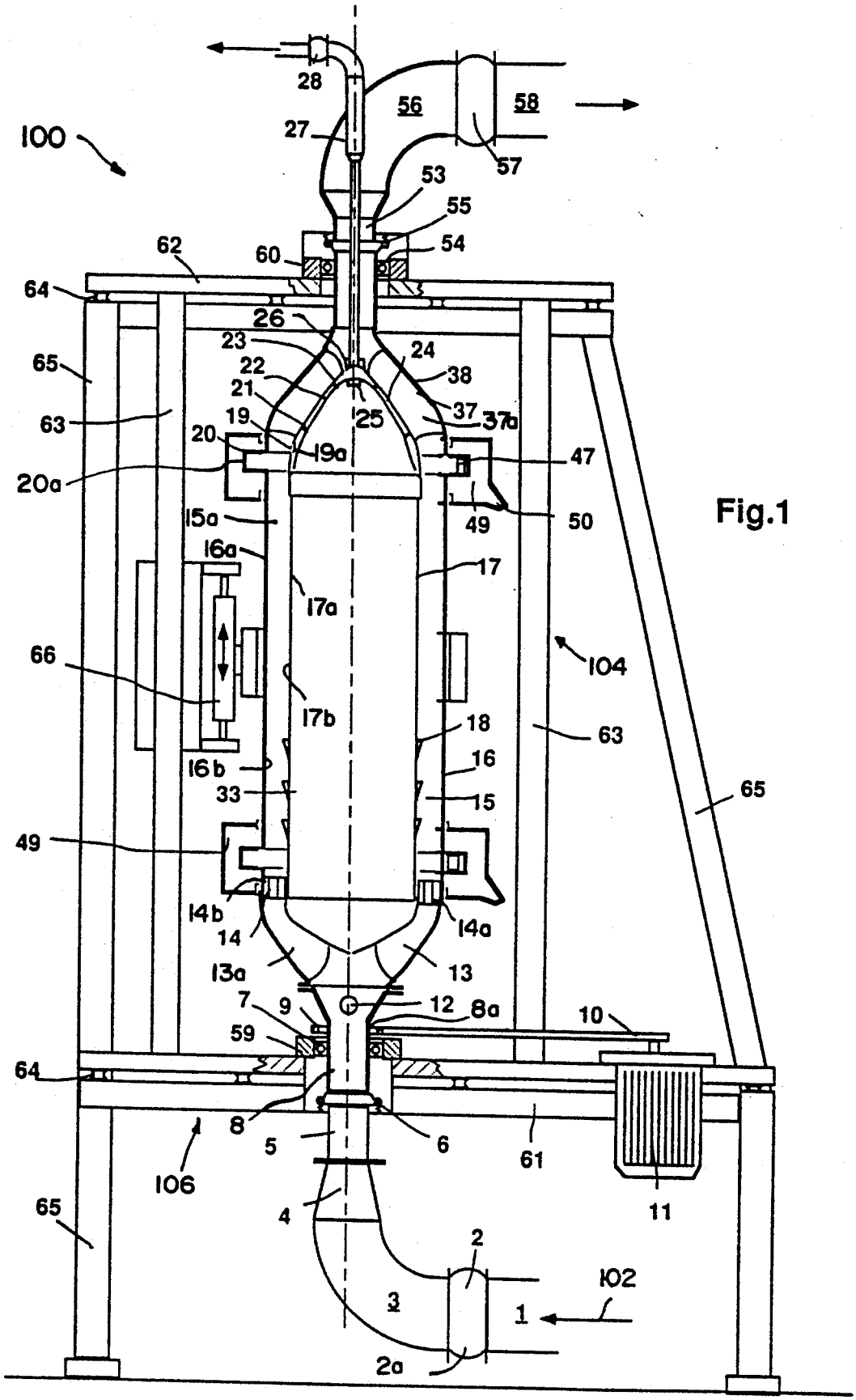
FIG. 1 schematically illustrates, partially in axial longitudinal sectional view, an exemplary embodiment of stock suspension cleaner or cleaning apparatus constructed according to the present invention.
Figure 2:
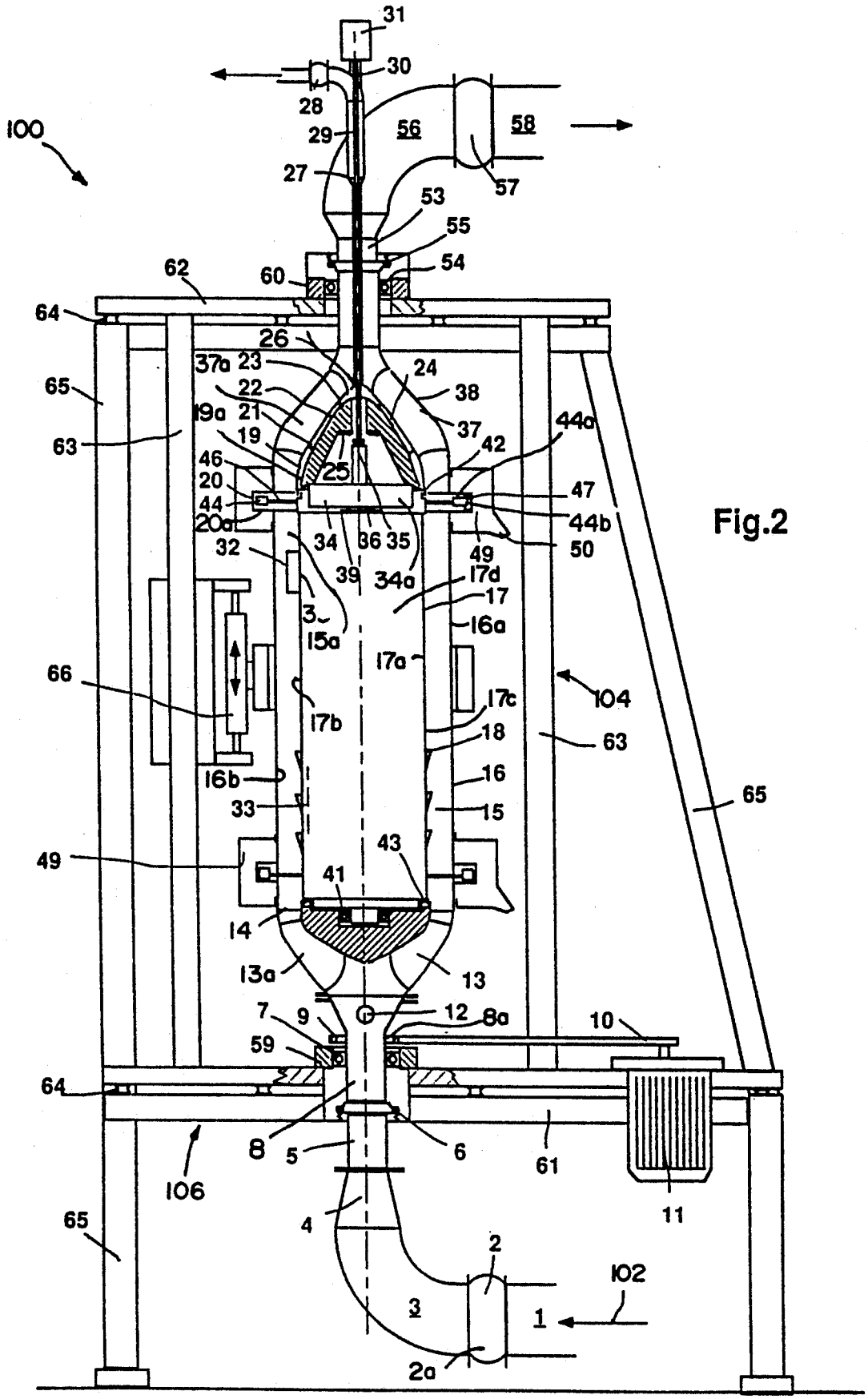
FIG. 2 schematically illustrates, again partially in axial longitudinal sectional view, a further particularly preferred exemplary embodiment of stock suspension cleaner or cleaning apparatus constructed according to the present invention.

Turning attention now to the two exemplary embodiments of stock suspension cleaners 100 respectively depicted in FIGS. 1 and 2 of the drawings, it will be understood that in each case the stock suspension, here typically for example a fiber stock suspension formed from waste paper, is delivered by an infed conduit or pipe 1 to the cleaner 100. In the two exemplary embodiments under discussion, each such stock suspension cleaner 100 is advantageously erected in an upright or substantially vertical disposition. An elastic element 2, for instance a rubber compensator **2*a*, prevents the transfer of any appreciable forces emanating from the infeed conduit or pipe 1 to the cleaner 100. A bend or curved pipe 3 having a conical or tapered section 4 is arranged downstream of the compensator 2, as viewed with respect to a predetermined direction of infeed or flow of the fiber stock suspension as generally indicated by the arrow 102**.

The stock suspension is delivered through the conical or tapered section 4 into an axial inflow conduit or line 5. The previously described elements 1, 2, 3, 4 and 5 are all stationary and a suitable seal 6, such as a packing or a sliding ring seal and a bearing 59 are arranged between these stationary elements 1 to 5 and the subsequently located rotary part of the cleaner or cleaning apparatus 100 to be further considered. This bearing or bearing structure 59 can take-up both axial and radial forces.

Moreover, the stock suspension flows through a conical element 8 carrying at a flange, generally indicated by reference numeral **8*a*, a toothed ring or rim 9. A toothed belt 10 revolvingly driven by a suitable drive motor 11 is trained about the toothed ring or rim 9 and thus serves to rotate the entire stock suspension cleaner 100 The conical element 8 simultaneously defines an easily removable structural part which is initially dismantled when performing maintenance or servicing work at the stock suspension cleaner 100 as will be further explained. Moreover, this conical element 8 is provided with access openings or ports 12** enabling inspection and, when necessary or desired, cleaning of critical infeed or inlet elements of the equipment which are particularly susceptible to contamination or soiling.

With respect to the predetermined direction of movement or flow 102 of the stock suspension through the stock suspension cleaner 100, a pump-like inlet blade structure or blading 13 is situated downstream of the conical element 8. This pump-like inlet blade structure 13 is constructed such that it receives the incoming stock suspension flow or stream relatively free of surges or impacts, forwardly advances or feeds such stock suspension flow through a flow path of larger radius and then discharges the stock suspension flow substantially in axial direction of an annular separation chamber or compartment 15 to be more fully considered shortly. The pump-like inlet blade structure 13 is designed such that at no location are there present throughflow spaces or gaps which are less than, for example, 12 mm., so that even if the stock suspension contains relatively coarse solid particles these will not tend to clog the stock suspension cleaner 100.

At the outlet end of such pump-like inlet blade structure or blading 13 the flow channels suddenly widen in the manner of a stepped diffusor 14, specifically shown in FIG. 1 and for purposes of simplifying the drawing illustration only generally indicated by reference numeral 14 in the second embodiment of FIG. 2, although equally present therein. With further particular reference to FIG. 1, it will be seen that a first widened channel or chamber of the stepped diffusor 14 has been generally indicated by reference numeral 14*a*. From this location there follows a second stepped diffusor-jump or step 14*b* to the dimension of the annular or circular ring-shaped separation chamber 15, thereby defining a double-stage stepped diffusor structure. The purpose of such step-like or jump-like widening of the flow channels is to bring about an increased turbulence of the stock suspension entering the corresponding annular or circular ring-shaped separation chamber 15. This increased or high turbulence of the stock suspension is capable of tearing apart or disintegrating individual fiber agglomerations or lumps and to free any light and heavy particles or rejects possibly entrapped therein as well as fibers. In the embodiments under discussion, there are provided the same number of individual diffusor channels 14 as there are provided channels for the inlet blades 13*a* of the inlet blading structure 13.

In both embodiments depicted in FIGS. 1 and 2, the separation chamber 15 is formed and bounded by walls 16*a* and 17*a* of the concentric and coaxially arranged outer cylinder 16 and inner cylinder 17, respectively. To achieve favorable separation conditions of the stock suspension and throughflow velocities thereof there is advantageously provided a ratio of the radius of the inner cylinder 17 to the outer cylinder 16 in a range of about 0.50 to 1.0, preferably about 0.75, most preferably about 0.7.

Particularly for the embodiment of FIG. 2 which enables relative rotational movement between the inner cylinder 17 and the outer cylinder 16 as will be shortly explained, and for the purpose of augmenting the flow turbulence of the stock suspension, and thus, hindering the accumulation of particles at the cylinder walls, especially at the wall 17*a* of the inner cylinder or cylinder member 17, such cylinder wall 17*a* is provided with nose-like protuberances or projections 18 defining turbulence-generating means or elements. Those skilled in this art will readily recognize that there are available for selection a number of different constructions of turbulence-generating elements which can be arranged at the region of the annular separation chamber 15 and can protrude into such annular separation chamber 15, and thus, into the throughflowing stock suspension in order to increase the turbulence thereof.

Due to the centrifugal force arising during operation of the stock suspension cleaner 100 within the separation chamber 15 the light particles or rejects will tend to collect at the outer wall 17*b* of the inner cylinder 17, whereas the heavy particles or rejects will be carried towards the inner wall 16*b* of the outer cylinder 16. These walls 16*b* and 17*b* define boundary walls which bound or delimit the separation chamber 15. At the outlet end or end region 15*a* of the separation chamber 15 there are provided withdrawal or removal devices 19 and 20 for the light particles and heavy particles, respectively. For the light particles or rejects the withdrawal or removal device 19 comprises chute-like discharge openings or recesses 19*a* provided at the inner cylinder 17 and which communicate with subsequently arranged withdrawal or removal channels 21. These withdrawal or removal channels 21 are formed between two conical jackets or shells 22 and 23 interconnected by connection ribs or struts 24 and which terminate or close off the inner cylinder 17 towards the top thereof. The two conical jackets or shells 22 and 23 terminate at suitable seals, generally represented by reference numerals 25 and 26. The light particles or rejects, containing a certain amount of the stock suspension, flow into a stationary central pipe or tube 27 which increases in size or widens in the direction of the particle flow and finally extends towards the outside of the stock suspension cleaner 100 by way of an elastic element 28.

It is here remarked that it has been found advantageous if the quantity of the stock suspension flow which accompanies the light particles or rejects amounts to about 0.5% to 3.0% of the throughput stock suspension entering the stock suspension cleaner 100.

Continuing, it will be seen by further reverting to FIGS. 1 and 2, the conical jackets or shells 22 and 23, which are interconnected by the ribs or struts 24, are fixedly connected by blades or blading 37*a* of turbine-like outlet blading structure 37 with a substantially conical end part or portion 38 of the stock suspension cleaner 100. This conical end part or portion 38 forms the closure or termination of the outer cylinder 16 which can be rotated by the drive motor 11.

In the embodiment of FIG. 1, the inner cylinder 17 and outer cylinder 16 are rotatably interconnected at their respective inlet and outlet regions by the inlet blading structure 13 and outlet blading structure 37, so that, here, there is no relative rotational movement between the inner cylinder 17 and outer cylinder 16.

In contrast thereto, in the embodiment of FIG. 2, the inner cylinder 17 defines a multi-part inner cylinder which includes a separate rotatably mounted inner cylinder part or component 17*c* so that there is possible relative rotation between such inner cylinder 17 and outer cylinder 16, as will be further considered shortly. In order to be able to drive such separate inner cylinder part or component 17*c* at a desired rotational speed there is arranged at the center of the stationary central pipe or tube 27 a shaft 29 which is coupled with a gearing-drive shaft 35. This shaft 29 is motor-driven at a desired rotational speed by an auxiliary drive motor 31 in order to accomplish the desired rotational speed difference between the inner cylinder 17 and outer cylinder 16. Therefore, this shaft 29 extends through a seal or packing gland 30 outwardly of the stationary central pipe or tube 27 where it is operatively connected with the auxiliary drive motor 31 to achieve such relative rotation between these cylinders 16 and 17.

Continuing, and with reference again to both FIGS. 1 and 2, it will be appreciated that the heavy particles or rejects drop at the end region of the relevant separation chamber 15 into an associated ring-shaped or annular collecting groove or receiver 20*a* of a related removal device 20 and provided at the circumference of the outer cylinder 16. Each such ring-shaped or annular collecting groove or receiver 20*a* extends in the circumferential or peripheral direction of the associated separation chamber 15.

In the embodiment of FIG. 1, these heavy particles or rejects which are propelled by the force of the stock suspension flowing through the annular separation chamber 15 into the annular collecting groove or receiver 20*a* are then delivered through exit or discharge openings, so-called saveall openings 47 which can be appropriately periodically opened and closed and thus deposited into a stationary collecting trough or vat 49 which surrounds the outer cylinder 16 and provided at least at one location with a removal conduit or pipe 50.

In the embodiment of FIG. 2 and in order to further ensure that the heavy particles or rejects, which impact at a random location against the inner wall 16*b* of the outer cylinder 16, are also reliably conveyed to the ring-shaped or annular collecting groove or receiver 20, there are advantageously provided elastic scrapers or doctor blades 32 or equivalent structure. These elastic scrapers or doctor blades 32 are inserted into and held within associated grooves or recesses 33 provided at the inner cylinder 17 and which extend substantially axially parallel to the lengthwise or longitudinal axis of this inner cylinder 17. Such elastic scrapers or doctor blades 32 are not present in the embodiment of FIG. 1, since there is no relative rotation between the inner cylinder 17 and the outer cylinder 16.

During operation of the stock suspension cleaner 100 of the embodiment of FIG. 2, the inner cylinder 17 rotates at a reduced speed relative to the outer cylinder 16, that is to say, assuming a rotational speed of the outer cylinder 16 of, for example, 1500 rpm., then the inner cylinder 17 rotates, for instance, at a rotational speed of, for instance, 1490 rpm. in the same rotational direction. The inner cylinder 17 is driven by means of suitable revolving speed reduction gearing 34 equipped with aligned drive shaft 35 and power take-off shaft 36. The housing 34*a* of such speed reduction gearing 34 is fixedly connected with the conical jacket or shell 22, and the drive shaft 35 is either retained at null rotational speed by the shaft 29 coupled therewith or appropriately rotated by means of the auxiliary drive motor 31.

As previously explained, the conical jackets or shells 22 and 23, which are interconnected by the ribs or struts 24, are fixedly connected by the blades or blading 37*a* of the turbine-like outlet blading structure 37 with a substantially conical end part or portion 38 of the stock suspension cleaner 100. This conical end part or portion 38 forms the closure or termination of the outer cylinder 16 which can be rotated by the drive motor 11. From this force- as well as form-locking closed system there is force-lockingly separated the rotatable inner cylinder part or component 17*c* of the inner cylinder 17, defining a divided inner cylinder structure, and which delimits or bounds the separation chamber 15, so that this separate inner cylinder part 17*c* can be independently driven relative to the outer cylinder 16 by the aforedescribed drive structure or auxiliary drive motor 31, as previously discussed.

By further inspecting FIG. 2, it will be seen an entrainment coupling or coupling member 39 located at the power take-off shaft 36 drives the separate part 17*c* of the inner cylinder 17 at the somewhat reduced rotational speed in relation to the above-discussed system connected with the outer cylinder 16. In order that such part 17*c* of the inner cylinder 17 can perform the explained relative rotational movement, it is separated from the inner conical jacket or shell 22 and is rotatably mounted at both ends, namely, at its top as well as its bottom regions, in appropriate bearings 41. Suitable seals or glands 42 and 43 prevent entry of stock suspension from the separation chamber 15 into the hollow interior or internal chamber 17*d* of the inner cylinder 17.

Due to the relatively slow relative movement between the outer cylinder 16 and the inner cylinder 17 the scrapers 32 of the arrangement of FIG. 2 wipingly contact or scrape the inner wall 16*b* of the outer cylinder 16 and thus prevent caking or accumulation of heavy particles or rejects at this location. Moreover, the heavy particles or rejects are further conveyed by the augmenting flow drag forces until they drop into the ring-shaped or annular collecting groove or receiver 20.

The heavy particles or rejects which have deposited in this ring-shaped or annular collecting groove or receiver 20 are dragged at that location in circumferential direction by ribs 44*b* or equivalent structure provided at a pusher or slide ring 44 which is likewise co-moved by the rotatable cylinder part 17*c* of the inner cylinder 17 by means of arms and/or drag bolts 46 or equivalent structure inserted into predetermined ones of the grooves or recesses 33, until such heavy particles or rejects reach the region of the exit or discharge openings, the so-called saveall openings 47 leading away from the ring-shaped or annular collecting groove or receiver 20. The pusher or slide ring 44 is provided with one or more pusher or slide openings, generally indicated at 44*a* which extend outwardly through the pusher or slide ring 44. At the moment when, during rotation of the pusher or slide ring 44, this pusher opening or openings 44*a* are located at the region of the saveall openings 47, a stock jet which moves outwardly through each such pusher opening 44*a* and is of limited short time duration due to the revolving motion of the pusher ring 44, ejects the heavy particles or rejects through the relevant saveall opening 47 and impacts against a wall of the associated stationary collecting trough or vat 49. As previously explained, this stationary collecting trough or vat 49 can be formed of two parts and surrounds the outer cylinder 16. Further, as likewise previously considered, such stationary collecting trough or vat 49 is provided at least at one location with the removal conduit or pipe 50. To avoid the escape of water or stock suspension spatters at undesired locations, there are provided suitable seals between the stationary collecting trough or vat 49 and the wall 16*a* of the outer cylinder 16.

The jet effluxing from the relevant saveall opening 47 is advantageously deflected in such a manner that it extends rearwardly with respect to the direction of rotation of the outer cylinder 16. To that end, there is mounted a suitable and thus not here shown curved deflection element at the region of the related saveall opening 47 at the outer wall of the outer cylinder 16.

It is here again mentioned that there are advantageously provided a plurality of these saveall openings 47 which are distributed in symmetrical arrangement or equidistantly about the circumference of the outer cylinder 16 and which are simultaneously controlled, that is, selectively opened and closed by the pusher or slide ring 44.

Furthermore, a similar heavy particle-removal device 20 can be provided at the inlet side-region of the separation chamber 15 and/or at the central region thereof. This modification would be advantageous in those instances where there are separated an excessively large proportion of relatively heavy or dense heavy particles or rejects which, then, need not be transported too far upwardly through the stock suspension cleaner 100.

In both of the embodiments of FIGS. 1 and 2, the removal of the good stock, that is, the cleaned stock suspension, is accomplished through the conical end part or portion 38 of the outer cylinder 16 by means of the thereat connected blades 37*a* of the turbine-like outlet blading 37. It will be recalled these blades 37*a* are also secured to the conical jacket or shell 23. Such blades 37*a* are curved at the outside side or ends thereof such that they convey the stock flow free of spin into a coaxially arranged outlet or removal conduit or pipe 53. This outlet conduit or pipe 53 carries a bearing 54, a so-called loose bearing which does not take-up any axial forces and allows for displacement of the outlet conduit or pipe 53 in axial direction. A seal 55 or the like also is carried by such outlet conduit or pipe 53. Downstream of the outlet conduit or pipe 53 there is arranged at the outlet side or region of the stock suspension cleaner 100 a curved bend 56 as well as an elastic intermediate element 57 and finally an outlet conduit or line 58.

As will be observed from FIGS. 1 and 2, the lower bearing 7 and the upper bearing 54 are installed in bearing housings 59 and 60, respectively, which, in turn, are each secured to an associated plate or plate member 61 and 62, respectively. These plates 61 and 62 are rigidly connected with one another by a plurality of deformation-resistant connection elements 63, for example, tubes or tubular elements. These two plates 61 and 62 together with the connection elements 63 form an inner frame or frame structure which is relatively rigid and substantially light-weight, and has been generally indicated by reference numeral 104. The drive motor 11 is also shown connected with the one plate 61, in other words, here the lower plate.

The inner frame or frame structure 104 composed of the elements 61, 62 and 63 is supported by a suitable number of rubber-elastic, harder or softer, dampening elements 64 upon an outer frame or frame structure 106 composed of suitably arranged supports or carriers 65.

A notable advantage of this arrangement of the different embodiments of stock suspension cleaners 100 in two frames or frame structures 104 and 106, namely, the inner frame structure 104 and the outer frame structure 106, resides in the fact that a critical rotational speed of the stock suspension cleaner 100 which rotates when in operation, can be varied throughout wide limits. By judicious or appropriate selection of the site, number and hardness of the rubber-elastic elements 64 the critical rotational speed thus can be shifted into an innocuous speed range.

At the inner frame structure 104, if desired or required, also at the outer frame structure 106, there can be mounted a protective guard or security arrangement which precludes contact by the operating personnel with the rotating stock suspension cleaner 100.

In order to be able to perform maintenance or servicing work at the stock suspension cleaner 100, such as exchange of the scrapers 32 of the embodiment of FIG. 2, or inspection and cleaning of the blading structure 13 and 37, or maintenance or servicing of the gearing 34, following removal of the collecting trough or vat 49 there are initially released the flange connections of the dismountable conical element 8, then there is engaged by means of an engagement or displacement device 66 the outer cylinder 16, such is raised a short distance, such as through a distance of a few millimeters, so that the dismountable conical element 8 can be lifted out of its support or fittings and removed towards the side. After releasing a flange connection at the heavy particle-removal device 20 comprising the annular collecting groove or receiver 20*a*, then through the use of the engagement or displacement device 66 the entire separation chamber 15 together with the inlet blading 13 can be lowered until there appears the gearing coupling 39 of the inherently separately rotatable part 17*a* of the inner cylinder 17 and such enables lateral displacement of the entire separation chamber 15. Now it is possible to upwardly remove the scrapers 32 in axial direction out of their grooves or recesses 33, and when necessary or desired, insert new scrapers 32 or the like. It is now equally possible to also inspect the accessible pusher or slide ring 44 or equivalent facility and, again if necessary or desired, to replace the same. The blading structures 13 and 37 are likewise accessible.

While there are shown and described present preferred embodiments of the invention, it is distinctly to be understood the invention is not limited thereto, but may be otherwise variously embodied and practiced within the scope of the following claims.

What is claimed is:

1. A cleaner for stock suspensions, especially for fiber stock suspensions formed from waste paper, from which there are be eliminated particles, such as light particles or light and heavy particles, comprising:

a rotatable hollow outer cylinder;

an inner cylinder coaxially arranged for rotation within said rotatable hollow outer cylinder;

said inner cylinder having a wall surrounding an internal chamber and an outlet side;

an annular separation chamber located between the rotatable hollow outer cylinder and the inner cylinder;

the stock suspension moving in a predetermined direction of flow in substantially axial direction through said separation chamber;

pump-like inlet blade means provided for the separation chamber for the transport of the stock suspension into the separation chamber;

turbine-like outlet blade means provided for the separation chamber downstream of the pump-like inlet blade means;

a separate discharge for the light particles leading from the separation chamber;

a multi-stage stepped diffusor arranged directly downstream of the pump-like inlet blade means with respect to the predetermined direction of flow of the stock suspension;

said multi-stage stepped diffusor flow communicating with the separation chamber;

means defining discharge openings provided at an end of the inner cylinder located at the region of the outlet side of said inner cylinder;

said discharge openings serving for the removal of the light particles;

said discharge openings being located upstream of the turbine-like outlet blade means with respect to the predetermined direction of flow of the stock suspension;

said discharge openings extending through the wall of the inner cylinder into said internal chamber of said inner cylinder for the throughput of the separated light particles together with a liquid constituent; and the turbine-like outlet blade means being structured for receiving and transporting a main stream of cleaned stock suspension.

2. The cleaner for stock suspensions according to claim 1, further including:

a separate discharge for the heavy particles provided for the separation chamber.

3. The cleaner for stock suspensions according to claim 1, further including:

a separate discharge for the cleaned stock suspension provided for the separation chamber.

4. The cleaner for stock suspensions according to claim 1, wherein:

the rotatable hollow outer cylinder comprises a wall;

at least one collecting groove provided at the wall of the rotatable hollow outer cylinder for the removal of heavy particles;

said at least one collecting groove being provided with opening means which can be periodically opened and closed, so that heavy particles collected during operation of the cleaner can be outwardly removed through said opening means at periodic time intervals by excess pressure of the stock suspension prevailing in the separation chamber;

said walls of the inner and outer cylinders defining boundary walls of the separation chamber; and means provided at the region of the separation chamber for augmenting movement of the heavy particles along the boundary walls of the separation chamber in the direction of at least the openings for the removal of the light particles and for preventing accumulation of the separated particles at the boundary walls of the separation chamber.

5. The cleaner for stock suspensions according to claim 4, wherein:

the means for augmenting movement of the heavy particles comprises protuberance means provided at least at one of the walls of the inner and outer cylinders bounding the separation chamber.

6. The cleaner for stock suspensions according to claim 5, wherein:

the protuberance means comprise axially spaced nose members mounted at the wall of the inner cylinder.

7. The cleaner for stock suspensions according to claim 4, wherein:

said opening means define a plurality of openings leading out of the collecting groove and arranged in substantially uniform circumferential spacing about the wall of the rotatable hollow cylinder.

8. The cleaner for stock suspensions according to claim 7, further including:

deflection means for rearwardly deflecting an emerging stock suspension jet charged with heavy particles, during operation of the cleaner, relative to the direction of rotation of the rotatable hollow outer cylinder; and said deflection means being secured at the rotatable hollow outer cylinder behind the openings leading out of the collecting groove.

9. The cleaner for stock suspensions according to claim 1, wherein:

the inner cylinder comprises a divided inner cylinder including an inner cylinder part which bounds the separation chamber;

means for rotatably driving the rotatable hollow outer cylinder at a predetermined rotational speed; and means for rotatably driving the inner cylinder part at a predetermined rotational speed differing from the predetermined rotational speed of the rotatable hollow outer cylinder.

10. The cleaner for stock suspensions according to claim 9, wherein:

the rotatable hollow outer cylinder comprises an inner wall;

at least one collecting groove provided at the inner wall of the rotatable hollow outer cylinder for the removal of heavy particles; and at least one scraper provided for the inner cylinder part which, during operation of the cleaner, transports heavy particles separated at the inner wall of the rotatable hollow outer cylinder augmented by flow-drag forces of the stock suspension in the direction of the at least one collecting groove.

11. The cleaner for stock suspensions according to claim 10, further including:

a pusher ring;

means for connecting the pusher ring with the inner cylinder part;

said at least one collecting groove being provided with opening means extending through the inner wall of the rotatable hollow outer cylinder and which can be periodically opened and closed, so that the heavy particles collected during operation of the cleaner can be outwardly removed through said opening means at periodic time intervals by excess pressure of the stock suspension prevailing in the separation chamber; and said pusher ring, during operation of the cleaner, rotating within the at least one collecting groove for moving the heavy particles collected in the at least one collecting groove at the region of the opening means and for periodically opening and closing said opening means during operation of the cleaner.

12. The cleaner for stock suspensions according to claim 10, wherein:

the multi-stage stepped diffusor arranged directly downstream of the pump-like inlet blade means with respect to the predetermined direction of flow of the stock suspension comprises a double-stage stepped diffusor having a predetermined number of individual diffusors;

said pump-like inlet blade means comprising a predetermined number of blades; and the predetermined number of individual diffusors of the double-stage stepped diffusor being equal to the predetermined number of blades of the pump-like inlet blade means.

13. The cleaner for stock suspensions according to claim 12, further including:

turbulence-generating means arranged downstream of the double-stage stepped diffusor and protruding into the separation chamber.

14. The cleaner for stock suspensions according to claim 10, wherein:

the inner cylinder has a lengthwise axis;

the wall of the inner cylinder is provided with at least one groove extending substantially axially parallel with respect to the lengthwise axis of the inner cylinder; and the at least one scraper being secured in said groove.

15. The cleaner for stock suspensions according to claim 10, further including:

a plurality of said scrapers; and said plurality of scrapers being substantially uniformly circumferentially distributed about the wall of the inner cylinder.

16. The cleaner for stock suspensions according to claim 9, wherein:

said driving means for rotatably driving the inner cylinder part comprises speed reduction gearing;

drive shaft means and power take-off means arranged substantially coaxially with respect to the inner cylinder part;

an auxiliary drive motor;

said drive shaft means operatively connecting said speed reduction gearing with the auxiliary drive motor; and said speed reduction gearing, during operation of the cleaner, enabling adjustment of the rotational speed of the inner cylinder to a value different from the rotational speed of the rotatable hollow outer cylinder.

17. The cleaner for stock suspensions according to claim 16, further including:

means for the removal of the light particles from the internal chamber of the inner cylinder;

said removal means comprising a removal pipe arranged substantially coaxially with respect to the internal chamber of the inner cylinder; and said drive shaft means being coaxially arranged with respect to the removal pipe.

18. The cleaner for stock suspensions according to claim 16, wherein:

said auxiliary drive motor rotates said drive shaft means during operation of the cleaner.

19. The cleaner for stock suspensions according to claim 9, wherein:

the respective driving means for rotatably driving the inner cylinder and the rotatable hollow outer cylinder at different rotational speeds enable attaining a rotational speed difference between the inner cylinder and the rotatable hollow outer cylinder in the range of 0.1% to 2.0% of the rotational speed of the rotatable hollow outer cylinder.

20. The cleaner for stock suspensions according to claim 19, wherein:

the respective means for rotatably driving the inner cylinder and the rotatable hollow outer cylinder at different rotational speeds enable attaining a rotational speed difference between the inner cylinder and the rotatable hollow outer cylinder in the order of about 0.5% of the rotational speed of the rotatable hollow outer cylinder.

21. The cleaner for stock suspensions according to claim 1, wherein:

the rotatable hollow outer cylinder has a predetermined radius;

the inner cylinder has a predetermined radius; and the predetermined radius of the inner cylinder with respect to the predetermined radius of the rotatable hollow outer cylinder has as radius ratio in the range of about 0.5 to 1.

22. The cleaner for stock suspensions according to claim 21, wherein:

said radius ratio amounts to about 0.7.

23. The cleaner for stock suspensions according to claim 1, wherein:

the separation chamber comprises a starting region and a outlet end;

at least one collecting groove for the heavy particles provided for the rotatable hollow outer cylinder at the region of the outlet end of the separation chamber upstream of the turbine-like outlet blade means with respect to the predetermined direction of flow of the stock suspension; and a collecting groove provided at the starting region of the separation chamber as viewed with respect to the predetermined direction of flow of the stock suspension at the region of the multi-stage stepped diffusor.

24. The cleaner for stocks suspensions according to claim 1, further including:

wear-resistant covering means provided for predetermined walls and parts of the cleaner coming into contact with concentrated heavy particles during operation of the cleaner.

25. The cleaner for stock suspensions according to claim 1, further including:

a stock suspension inlet;

an outlet for cleaned stock suspension;

an outlet for the light particles;

an outlet for the heavy particles;

the cleaner having a substantially upright lengthwise axis and an upper region and a lower region;

the stock suspension inlet being located at the lower region of the cleaner; and the respective outlets for the cleaned stock suspension, for the light particles and for the heavy particles being arranged at the upper region of the cleaner.

26. The cleaner for stock suspensions according to claim 25, further including:

a substantially light-weight, relatively rigid inner frame means for supporting the cleaner;

an outer frame means of increased strength relative to the strength of the substantially light-weight, relatively rigid inner frame means; and relatively soft and dampening elements for supporting said substantially light-weight, relatively rigid inner frame means in said outer frame means.

27. The cleaner for stock suspensions according to claim 26, wherein:

the number of said dampening elements, properties thereof and site of placement are variable depending upon requirements.

28. The cleaner for stock suspensions according to claim 25, wherein:

the inner cylinder comprises a divided inner cylinder including an inner cylinder part which bounds the separation chamber;

the rotatable hollow outer cylinder comprises an inner wall;

at least one collecting groove provided for the rotatable hollow outer cylinder for the removal of heavy particles;

at least one scraper provided for the inner cylinder part which, during operation of the cleaner, transports heavy particles separated at the inner wall of the rotatable hollow outer cylinder in conjunction with flow-drag forces of the stock suspension in the direction of the at least one collecting groove;

displacement means for displacing at least a part of the rotatable outer hollow cylinder together with a part of the inner cylinder; and the rotatable hollow outer cylinder possesses a divided structure at the region of an upper end of the separation chamber along a substantially horizontal section plane, so that a lower part of the rotatable hollow outer cylinder together with the rotatable part of the inner cylinder can be lowered and displaced by the displacement means, whereby the separation chamber is axially accessible from above for the exchange of the at least one scraper.

29. The cleaner for stock suspensions according to claim 1, further including:

readily dismountable means for enabling inspection and servicing of contaminant-prone sites of the cleaner.

30. A cleaner for stock suspensions, especially for fiber stock suspensions formed from waste paper, from which there are be eliminated particles, such as light particles or light and heavy particles, comprising:

a rotatable hollow outer cylinder;

an inner cylinder coaxially arranged for co-rotation within said rotatable hollow outer cylinder;

said inner cylinder having a wall surrounding an internal chamber and an outlet side;

an annular separation chamber located between the rotatable hollow outer cylinder and the inner cylinder;

the stock suspension moving in a predetermined direction of flow in substantially axial direction through said separation chamber;

inlet blade means provided for the separation chamber for the transport of the stock suspension into the separation chamber;

outlet blade means provided for the separation chamber downstream of the inlet blade means;

a separate discharge for the light particles leading from the separation chamber;

stepped diffusor means arranged directly downstream of the inlet blade means with respect to the predetermined direction of flow of the stock suspension;

said stepped diffusor means flow communicating with the separation chamber;

means defining discharge openings provided at an end of the inner cylinder located at the region of the outlet side of said inner cylinder;

said discharge openings serving for the removal of the light particles;

said discharge openings being located upstream of the outlet blade means with respect to the predetermined direction of flow of the stock suspension;

said discharge openings extending through the wall of the inner cylinder into said internal chamber of said inner cylinder for the throughput of the separated light particles together with a liquid constituent; and the outlet blade means being structured for receiving and transporting a main stream of cleaned stock suspension.

* * * * *